US009078501B2

(12) United States Patent
Johnson

(10) Patent No.: US 9,078,501 B2
(45) Date of Patent: Jul. 14, 2015

(54) CARRYING CASE WITH REMOVABLE AND INTERCHANGEABLE INSERTS

(75) Inventor: Richard W. Johnson, Stryker, OH (US)

(73) Assignee: RW Johnson Inventive Solutions LLC, Stryker, OH (US)

( * ) Notice: Subject to any disclaimer, the term of this patent is extended or adjusted under 35 U.S.C. 154(b) by 695 days.

(21) Appl. No.: 13/428,258

(22) Filed: Mar. 23, 2012

(65) Prior Publication Data

US 2012/0240521 A1 Sep. 27, 2012

Related U.S. Application Data

(60) Provisional application No. 61/467,370, filed on Mar. 24, 2011, provisional application No. 61/481,730, filed on May 3, 2011.

(51) Int. Cl.

| | |
|---|---|
| ***A45F 3/02*** | (2006.01) |
| ***A45C 13/02*** | (2006.01) |
| *A45C 3/02* | (2006.01) |
| *A45C 11/00* | (2006.01) |

(52) U.S. Cl.

CPC . *A45C 13/02* (2013.01); *A45C 3/02* (2013.01); *A45C 2011/003* (2013.01); *A45C 2011/007* (2013.01); *A45C 2013/026* (2013.01); *A45F 3/02* (2013.01)

(58) Field of Classification Search

USPC ..... 224/584, 581, 610–612, 614–622, 270, 224/271, 257; 190/108–110, 115; 206/581; 16/444

See application file for complete search history.

(56) References Cited

U.S. PATENT DOCUMENTS

| | | | | |
|---|---|---|---|---|
| 2,475,442 | A | 7/1949 | Baum | |
| 2,681,632 | A | 6/1954 | Rossman | |
| 4,386,642 | A | 6/1983 | Durbin | |
| 4,513,866 | A | 4/1985 | Thomas | |
| D319,002 | S * | 8/1991 | Mirza et al. | D8/373 |
| 5,207,303 | A | 5/1993 | Oswalt et al. | |
| 5,624,071 | A | 4/1997 | Sosan | |
| 5,655,270 | A * | 8/1997 | Boisvert | 24/336 |
| 5,865,314 | A | 2/1999 | Jacober | |
| 6,000,509 | A * | 12/1999 | Chisholm | 190/109 |
| 6,318,552 | B1 * | 11/2001 | Godshaw | 206/320 |
| 6,321,912 | B1 * | 11/2001 | Lippert et al. | 206/576 |
| 6,405,881 | B1 | 6/2002 | Park | |
| 6,597,568 | B2 * | 7/2003 | Ryder | 361/679.55 |
| 7,735,189 | B2 * | 6/2010 | Richardson | 16/87.2 |
| 2002/0088679 | A1 * | 7/2002 | Abraham | 190/111 |
| 2003/0029755 | A1 * | 2/2003 | Ho | 206/320 |

(Continued)

*Primary Examiner* — Brian D Nash
*Assistant Examiner* — Corey Skurdal
(74) *Attorney, Agent, or Firm* — Andrew W. Chu; Craft Chu PLLC

(57) ABSTRACT

An embodiment of the carrying case system of the present invention includes a front panel and a body portion. A transport strap and a handle attach to the body portion for the user to hold the carry case. There is an adjustable hold strap attached between the body portion and the front panel, so that the hinged relationship between the front panel and the body portion ranges from a closed position to an open position. Length of the adjustable hold strap sets the open position, forming a flat workspace with the back face of the front panel. The body portion also includes an attachment area, which removably engages an insert panel. The insert panels have different configurations of pockets, straps, and pouches. The carrying case system can be used for different functions related to the particular insert panel installed in the body portion.

9 Claims, 5 Drawing Sheets

(56) References Cited

U.S. PATENT DOCUMENTS

2004/0232288 A1 11/2004 Kung
2006/0144662 A1* 7/2006 Hu ..... 190/110
2007/0044877 A1* 3/2007 Davidoff et al. ..... 150/113
2009/0294491 A1 12/2009 Carver
2010/0307649 A1 12/2010 Santos Dominguez
2011/0010903 A1 1/2011 Starbuck

* cited by examiner

CARRYING CASE WITH REMOVABLE AND INTERCHANGEABLE INSERTS

RELATED U.S. APPLICATIONS

The present application claims priority under U.S. Code Section 119(e) from provisional patent applications, U.S. Patent Application No. 61/467,370, filed on 24 Mar. 2011 and entitled "MOBILE C/O KITS" and U.S. Patent Application No. 61/481,730 filed on 3 May 2011 and entitled "SPECIAL 'U' HANGER SYSTEM".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a carrying case. More particularly, the present invention relates to a carrying case with removable and interchangeable inserts and a portable table surface. The carrying case with inserts increases service life, functionality, and diversity of usage. The present invention further relates to accommodating supplies and providing work space on a table surface in a portable manner.

2. Description of Related Art Including Information Disclosed Under 37 CFR 1.97 and 37 CFR 1.98.

Certain medical procedures, such as self-catheterization, are unpleasant medical necessities for both male and female patients. Various medical conditions force patients to deal with these potentially embarrassing and personal procedures, such as urological difficulties, ostomy conditions, wounds, and diabetes. For example, for older men, prostatitis is inflammation of the prostate gland, and benign prostatic hyperplasia (BPH) occurs when the prostate often enlarges to the point where urination becomes difficult. These medical conditions require frequent monitoring, and symptoms can require frequent treatment. Part of the treatment plan may include medical procedures, such as self-catheterization, ostomy care, wound care, diabetes care, and others, requiring a variety of medical supplies. A patient must have access to these supplies and space to perform these procedures in order to relieve symptoms and to successfully comply with the treatment plan.

Maintaining the proper supplies and space for performing the procedures is much more suitable for the home setting. For example, using self-catheterization is sometimes required in order for a patient to urinate. The process involves cleanliness, multiple supplies, and adequate work space for supply preparation and patient preparation. However, patients require the freedom to leave home for extended periods of time in order to live their lives and maintain a healthy lifestyle. Away from home, access to supplies, proper space, and privacy are major concerns. Patients with these medical conditions feel restricted to their homes because of the anxiety of having to urinate away from home, even though there are generally no real physical restrictions from this medical condition. Other medical procedures, such as a ostomy care, wound care, and diabetes care, involve the same patient concerns.

The known first-aid kit holds a variety of medical supplies in a single carrying case. The range of first-aid kits covers a small box in an office supply closet to a specialized backpack for extreme weather conditions. These kits contain all of the necessary supplies, such as gloves, lubrication, catheters, etc. Even bulky items and multiple use supplies can be easily transported.

In the past, various patents have issued relating to first-aid kits and carrying cases for medical supplies. For example, U.S. Pat. No. 4,386,642, issued to Durbin on Jun. 7, 1983, discloses a universal portable pack, formed as a briefcase. There is a tray storage area providing receptacles for separately holding relatively long and narrow objects, which can be released from the case. There are hook and loop attachments for customizing individual pockets and storage. The pockets and areas can be color coded for identification and quick selection.

U.S. Pat. No. 5,865,314, issued to Jacober on Feb. 2, 1999, teaches a case for injectable medication with a cooling compartment. The invention is another specialized carrying case for medical equipment. There are panels, including a top panel, a bottom panel opposing the top panel, two opposing side panels, two opposing end panels, and a thermally-insulating divider panel. The panels join together at respective joints in the carrying case. The panels divide the case into insulated and non-insulated areas for convenient transport of medication.

U.S. Pat. No. 5,207,303, issued to Oswalt, et al. on May 4, 1993, describes a medical emergency carrying case. The device is a first-aid kit in a particular configuration to be carried as a case or as a backpack. There are storage pouches, which are releasably attached to hinged fasteners located along or near the rims of the top and bottom compartments of the carrying case. The hinged attachment allows the storage pouches to be flipped from inside the carrying case to outside the carrying case while still attached. This arrangement allows for visible access at once to every item transported in the carrying case.

The prior art generally discloses many specialized carrying cases with adjustable pockets, pouches, straps, and attachments. In particular, U.S. Pat. No. 2,475,442, issued to Baum on Jun. 19, 1946, U.S. Pat. No. 6,405,881, issued to Park on Jun. 18, 2002, and U.S. Patent Publication No. 2004/0232288, published for Kung on Nov. 25, 2004, disclose hook attachments to suspend articles on a wall or door. The concept of portable attachment is known, and there are many disclosed versions of a hook element for a carrying case.

Specialized kits and packs of the prior art lack variable functionality. The first-aid kits perform the intended function of holding and organizing different types of medical supplies in a single container. The backpacks and carriers with dividers also address the need for a portable single container. However, there is no flexibility for the use of these prior art carrying cases other than transport of medical supplies. Without a medical condition, there is no longer a need for a specialized kit or pack. If there is no medical need, then the prior art cannot be easily used for other purposes.

It is an object of the present invention to provide an embodiment of a carrying case for transporting a variety of different medical supplies.

It is another object of the present invention to provide an embodiment of a carrying case for organizing a variety of different medical supplies.

It is an object of the present invention to provide an embodiment of a carrying case with removable inserts.

It is another object of the present invention to provide an embodiment of a carrying case with a removable insert for holding medical supplies.

It is another object of the present invention to provide an embodiment of a carrying case with a removable insert for holding supplies for non-medical uses, such as a laptop computer.

It is another object of the present invention to provide an embodiment of a carrying case with attachments for medical procedures.

It is an object of the present invention to provide an embodiment of a carrying case, which forms a work space for medical procedures and non-medical uses.

It is still another object of the present invention to provide an embodiment of a carrying case, which can be installed in limited space.

It is another object of the present invention to provide an embodiment of a carrying case for medical supplies, which can be transported and carried without visual indicators of the medical supplies contained inside the case.

These and other objects and advantages of the present invention will become apparent from a reading of the attached specification and claims.

SUMMARY OF THE INVENTION

An embodiment of the carrying case system of the present invention includes a front panel and a body portion. The front panel has a front face and back face. The body portion has side walls forming an interior volume. The side walls have a rim edge releasably attaching to the front panel and a hinge portion to pivotally connect the front panel. A transport strap and a handle attach to the body portion for the user to hold the carrying case. Mounting hooks engage the transport strap or handle or combination of both in order to position the carrying case for use.

There is an adjustable hold strap attaching the front panel to the body portion, opposite to the hinged portion. The adjustable hold strap sets the closed and open positions of the front panel and body portion. The closed position has the adjustable hold strap contained within the interior volume, so that front panel and body portion are aligned and the rim edge can be zippered and closed. The open position occurs when the adjustable hold strap is extended between the front panel and the body portion to form a flat workspace with the back face of the front panel. The extension of the adjustable hold strap is determined by the adjustable length of the adjustable hold strap. Thus, the front panel and body portion can range from an acute angle to generally planar. In one embodiment, the front panel and the body portion are generally perpendicular. The adjustable hold strap can also be released or split, allowing the front panel to lie flat without support from the adjustable hold strap. Additionally, suspension hooks attach to the adjustable hold strap for mounting medical supplies. Also, lanyard clips removably contained in the body portion can also be used to assist the user.

The body portion also includes an attachment area, which removably engages an insert panel. Hook and loop fasteners, snaps, zippers, and other attachment devices removably connect the body portion and the insert panel. The insert panel is interchangeable with another insert panel. Each insert panel can have different configurations of pockets, straps, and pouches, according to specialized use, such as medical supplies, office supplies, tools, or even a laptop computer. The carrying case system can be used for different functions related to the particular insert panel installed in the body portion.

The method of using the carrying case system includes installing an insert panel when the front panel and body portion are placed in an open position. The insert panel can be filled with supplies, such as medical supplies. Tools, like catheters, colostomy bags, and disposable bandages can be kept organized in a single carrying case. The carrying case can be closed and transported. Accessing the supplies involves mounting the carrying case, even in limited space, and forming the workspace table with the front panel and adjustable hold strap. Switching the supplies involves removing the insert panel and installing a substitute insert panel. Each insert panel can be different for different functions. One insert panel may only include storage straps for stabilizing a laptop computer. Another insert panel may include pouches for classroom supplies. Once the need for transport of medical supplies has been met, the carrying case can still be used for non-medical content, such as office supplies or a computer.

DETAILED DESCRIPTION OF THE DRAWINGS

Figure 1:
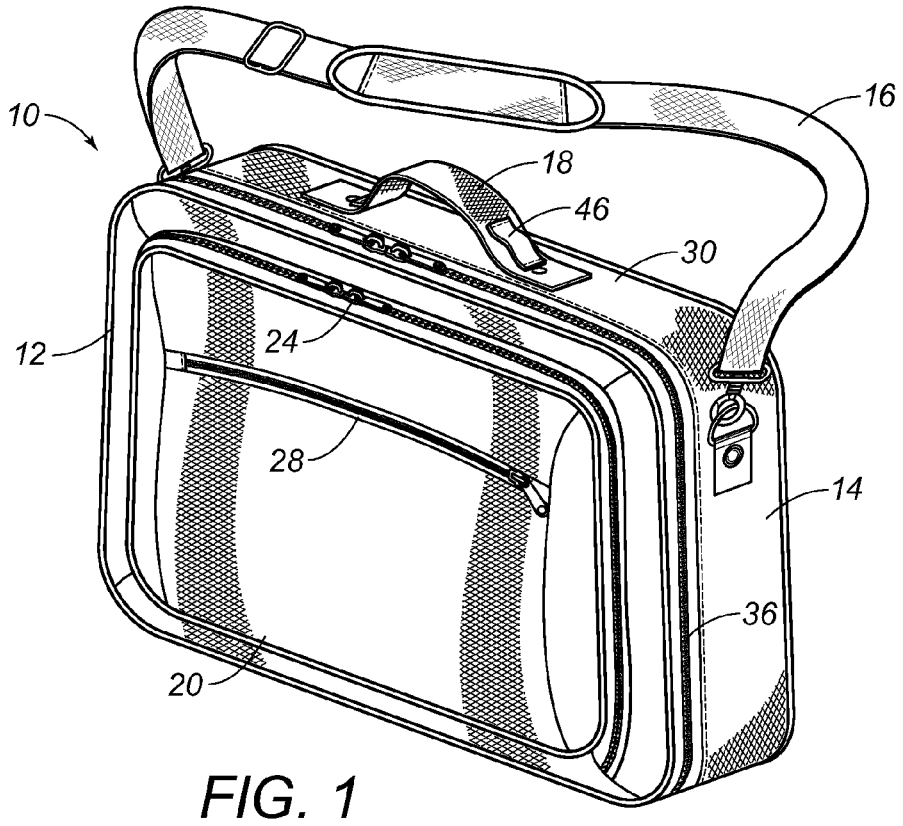
FIG. 1 is an upper perspective view of an embodiment of the carrying case system of the present invention.

Referring to FIGS. 1-5, embodiments of the carrying case system 10 of the present invention provide a discrete portable container for supplies of various shapes and sizes. For patients requiring access to medical supplies away from home, the carrying case system 10 organizes bandages, catheters, colostomy bags, latex gloves, and other materials. The carrying case system 10 has special compartments and structures to hold bottles, boxes, and other container shapes, as well as pockets and pouches to hold individually wrapped items. Further innovative attachments enable the medical procedures to be performed in limited space, such as connections for mounting on walls, wall hooks, rails, doors and other stable structures, for preparing for medical procedures. The outer appearance of the carrying case system 10 allows a patient to transport medical supplies in a discrete manner in public. The carrying case system 10 has interchangeable removable inserts in order to change the organization of the supplies, including options to convert the carrying case system 10 to hold alternative supplies and equipment, such as office supplies or a computer. After the need for the medical supplies has passed, the carrying case system 10 can appear to be a computer bag and actually function as a computer bag. The carrying case system 10 of the present invention presents an innovative solution for patients requiring treatment of medical conditions, while maintaining freedom to live an active lifestyle with reduced stress.

FIGS. 1-4 show the outer appearance of the carrying case system 10 with a front panel 12, a body portion 14, a transport strap means 16, and a handle means 18. The outer appearance is modular and sleek, similar in style to luggage. The contents of the carrying case system 10 may be medical supplies, but the outer appearance does not indicate this use of the system 10.

Figure 3:
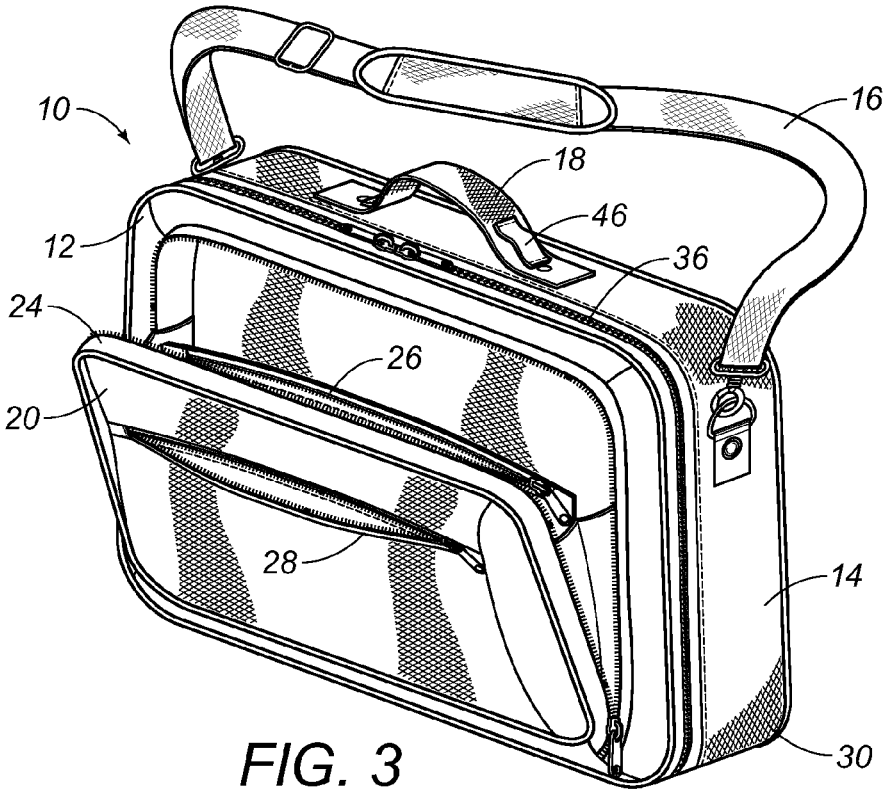
FIG. 3 is another upper perspective view of the embodiment of the carrying case system of the present invention of FIG. 1, showing the front panel with open front pocket and inner pocket.
Figure 5:
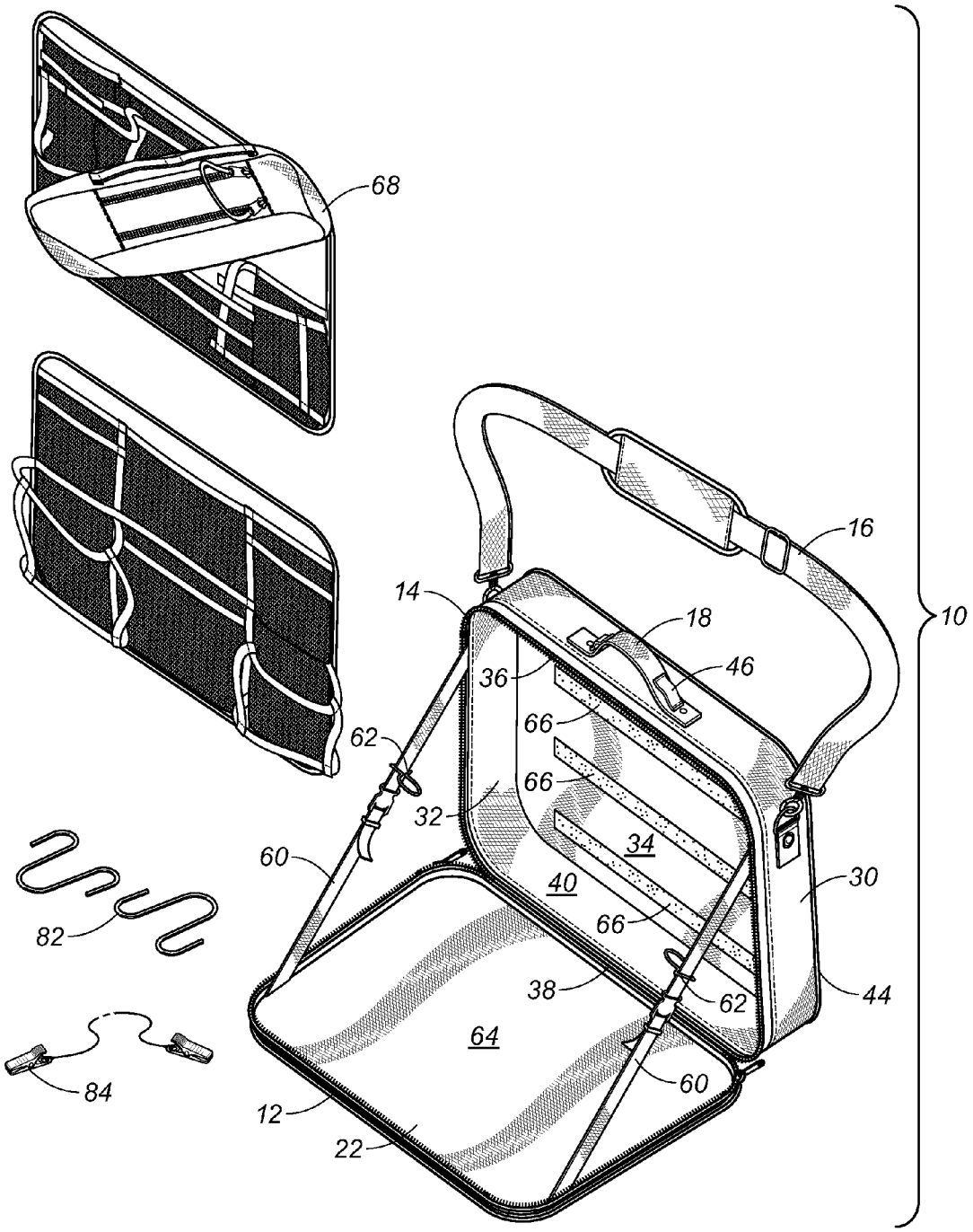
FIG. 5 is an exploded upper perspective view of the embodiment of the carrying case system of the present invention, showing an open position of the front panel and body portion.

FIG. 5 shows an exploded view of the inside of the carrying case system 10. The front panel 12 has a front face 20 and a back face 22 in FIGS. 1, 3 and 5. In particular, FIGS. 1 and 3 show the front panel 12 having a front pocket 24 made integral with the front face 20. FIG. 1 is the closed front pocket 24 with a zippered opening, and FIG. 3 shows the open front pocket 24. There is an inner pocket 26 housed within the front pocket 24, which can provide further organization within the front pocket 24. In one embodiment, the inner pocket 26 is comprised of transparent material so that contents of the inner pocket 26 are immediately visible. The inner pocket 26 may also hold wet or damp items. An additional pocket 28 is also shown with a zippered opening.

Figure 2:
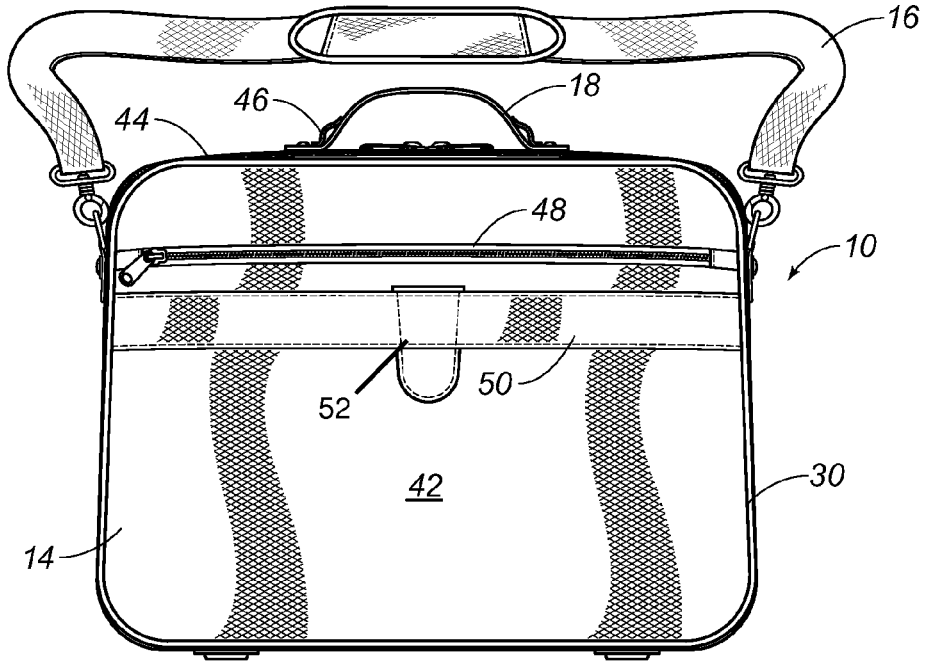
FIG. 2 is a back elevation view of the embodiment of the carrying case system of the present invention of FIG. 1.
Figure 4:
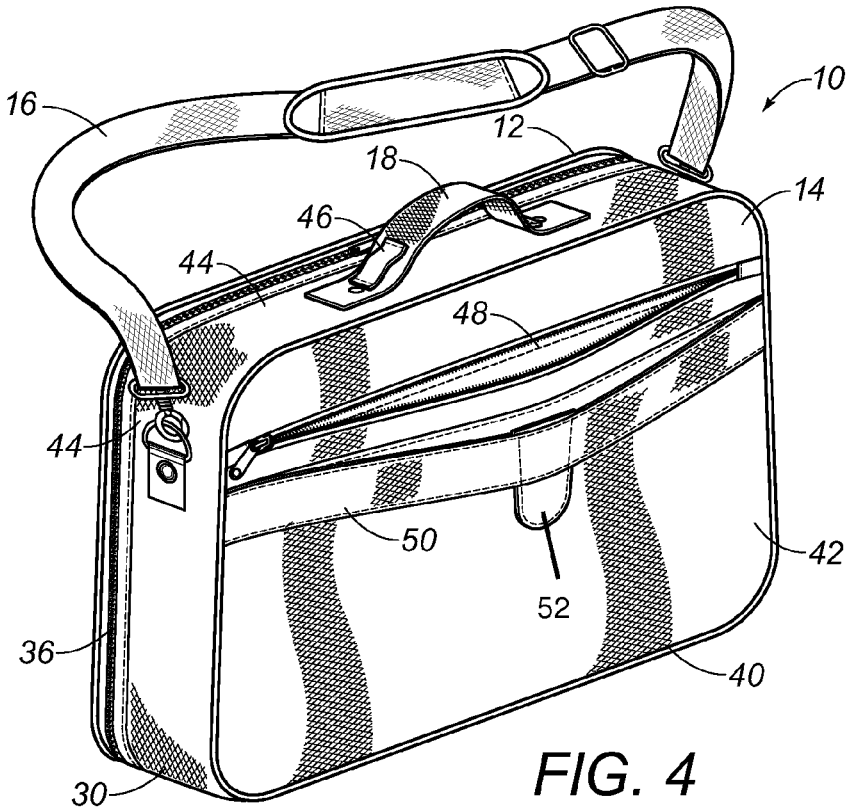
FIG. 4 is a back perspective view of the embodiment of the carrying case system of the present invention of FIG. 1, showing the body portion with an open pocket.

The front panel 12 can attach to the body portion 14. FIG. 5 shows the body portion 14 with a perimeter of side walls 30 forming an interior volume 32 on a front side 34 of the body portion 14. The back side 42 of the body portion 14 is shown in FIGS. 2 and 4. The body portion 14 is the containing structure of the carrying case system 10. The side walls 30 have a rim edge 36 releasably attached to the front panel 12 and a hinge portion 38 pivotally attached to the front panel 12 at a bottom end 40 of the body portion 14. The rim edge 36 of the side walls 30 and the front panel 12 are releasably attached through a zipper or other suitable means. The rim edge 36 attaches the front panel 12 along three sides of the body portion 14, and the hinge portion 38 is a permanent attachment of the front panel 12 to the body portion 14.

FIGS. 1-5 also show the transport strap means 16 with ends removably attached to an outside of the perimeter of side walls 30 towards a top end 44 of the body portion. The handle means 18 also fixedly attaches to the top end 44 of the body portion 14. The handle means 18 is opposite the hinge portion 38 on the bottom end 40 of the body portion 14. As shown in FIGS. 1-5, there are side loops 46 flush against the top of the handle means 18, and there is a pocket means 48 on a back side 42 of the body portion 14. FIG. 2 shows the closed pocket means 48, and FIG. 4 shows the opened pocket means 48. The pocket means 48 is shown as a zippered opening extending along the back side 42 of the body portion 14. FIGS. 2 and 4 also show a loop strap 50 extended across the back side 42 of the body portion 14. The loop strap 50 is fixed on both ends to the back side 42 of the body portion 14, and there is a releasable attachment 52 to the back side 42 of the body portion 14 between both ends, such as a hook and loop connector. The loop strap 50 can engage another piece of luggage, such as the telescoping handle of a suitcase. The telescoping handle slides between the loop strap 50 and the body portion 14, such that the carrying case system 10 can be easily transported with other luggage. The transport strap means 16, side loops 46, handle means 18, and loop strap 50 provide options for mounting the carrying case system 10 for use, transport or storage.

The interior view of FIG. 5 shows the adjustable hold strap means 60 of the carrying case system 10. The adjustable hold strap means 60 has one end attached toward the top end 44 of the body portion 14 and the front panel 12. A closed position of the front panel 12 and the body portion 14 allows the attachment of the front panel 12 to the rim edge 36. The hinge portion 38 is actuated to a closed position so that the front face 20 and the back face 22 of the front panel 12 are aligned with the front side 34 and the back side 42 of the body portion 14. An open position of the front panel 12 and the body portion 14 separates the rim edge 36 so that only the hinge portion 38 attaches the front panel 12 to the body portion 14. The hinge portion 38 is actuated open so that the front face 20 and the back face 22 of the front panel 12 are supported by the adjustable hold strap means 60. The open position occurs when the adjustable hold strap means 60 is extended between the front panel 12 and the body portion 14. The adjustable hold strap means 60 can be adjusted in length so that the open position of the front panel 12 can be supported at different angles relative to the body portion 14. The angle of the front panel 12 and body portion 14 can range from an acute angle to generally planar. FIG. 5 shows the open position as generally perpendicular with the adjustable hold strap means 60 extended and supporting the front panel 12. The adjustable hold strap means 60 may also be separated or split for fully hinging the front panel 12 open, which can be convenient for loading supplies and convenient for accessing the supplies when there is adequate room and no need to mount the carrying case system 10 and hold position of the front panel 12.

The suspension hook means 62 can be seen in FIG. 5 as well. The suspension hook means 62 engage the adjustment hold strap means 60 and are movable along a length of the adjustment hold strap means 60. Medical supplies, such as catheters, can be held by the suspension hook means 62. Medical procedures requiring gravity to load the catheters can now be performed easily and efficiently with the present invention. Non-medical supplies may also be suspended from the adjustment hold strap means 60.

Furthermore, the carrying case system 10 forms a table surface 64 in the open position of the front panel 12 and the body portion 14. The back face 22 of the front panel 12 hinges generally perpendicular to the body portion 14 in FIGS. 5 and 10. With a smooth work surface, the back face 22 is supported relative to the body portion 14 by the adjustment hold strap means 60. The table surface 64 is sufficiently durable to hold medical supplies being prepared for a procedure. In locations and spaces without a counter, such as a bathroom stall or portable toilet, the carrying case system 10 of the present invention can be easily and conveniently used by a patient. The patient is no longer forced to avoid these locations without counter space for their medical procedures. The table surface 64 may also be useful for non-medical uses as well.

Figure 9:
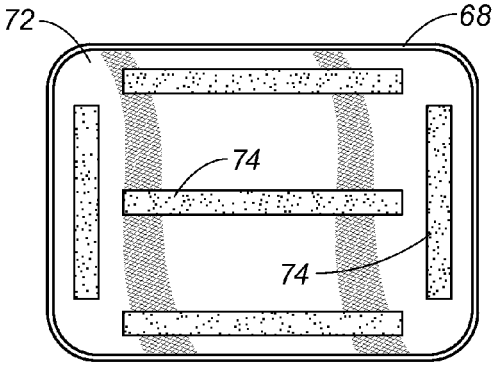
FIG. 9 is a back elevation view of an embodiment of an insert panel means of the carrying case system of the present invention.
Figure 10:
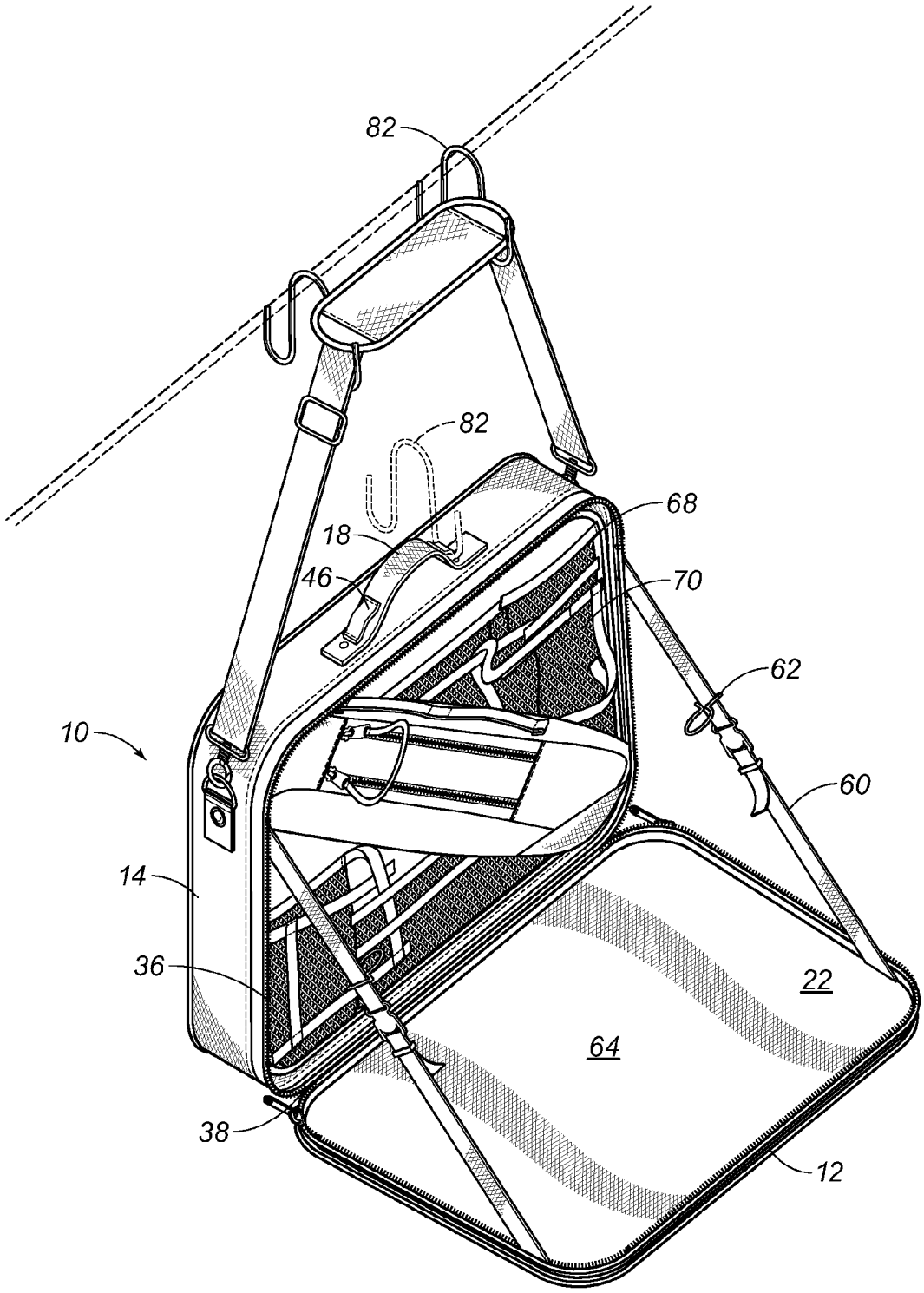
FIG. 10 is an upper perspective view of an embodiment of the carrying case system of the present invention mounted on a wall for access to supplies, showing alternative placement of mounting hooks in broken lines.

The carrying case system 10 of the present invention further includes an attachment means 66 mounted on the front side 34 of the body portion 14. The attachment means 66 removably attaches to an insert panel means 68. The insert panel means 68 fits within the interior volume 32 of the body portion 14 as shown in FIGS. 5 and 10. The insert panel 68 is shown in isolation in FIGS. 7 and 9, having a front panel face 70 and a back panel face 72. The back panel face 72 engages the attachment means 66 on the body portion 14. The insert panel means 68 can further comprise a complementary attachment means 74 spread across the back panel face 72 so as to engage the attachment means 66 of the body portion 14.

In one embodiment of the present invention, the attachment means 66 is comprised of a hook and loop fastener, wherein the insert panel means 68 has a complementary hook and loop fastener 74 for removable attachment to the body portion 14. FIG. 9 shows a pattern of the complementary hook and loop fastener 74. In alternate embodiments, the attachment means 66 may be formed by a button, snap, zipper or friction fit fastener. As such, the insert panel means 68 would have a complementary button, snap, zipper or friction fit fastener for removable attachment to the body portion 14.

Figure 6:
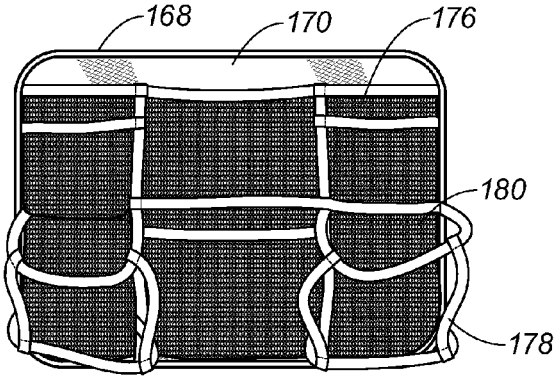
FIG. 6 is a front perspective view of an embodiment of an insert panel means of the carrying case system of the present invention.
Figure 8:
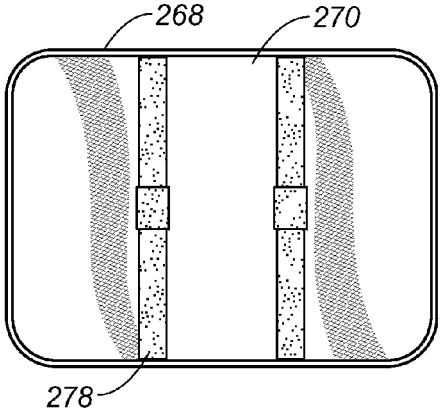
FIG. 8 is a front perspective view of an embodiment of still another insert panel means of the carrying case system of the present invention, showing another configuration of the front face of the insert panel.
Figure 7:
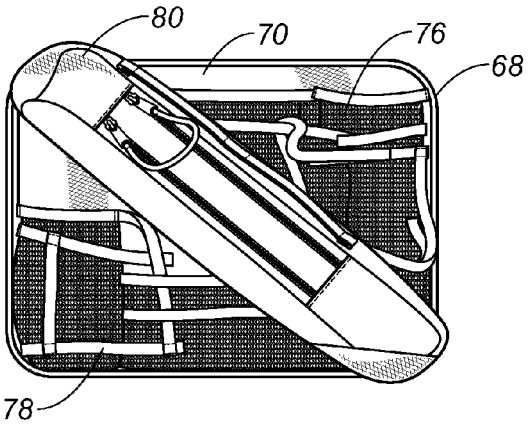
FIG. 7 is a front perspective view of an embodiment of another insert panel means of the carrying case system of the present invention, showing a different configuration of the front face of the insert panel.

FIGS. 5, 7 and 10 show one embodiment of the front panel face 70 of the insert panel means 68 comprising a plurality of pockets 76. There are also a plurality of supply straps 78 and pouches 80. FIG. 7 is shown with a catheter pouch 80. Each front panel face 70 can have a particular configuration according to the type of supplies required for transport. The catheter is usually delicate and awkward to carry, and the carrying case system 10 can discretely and safely transport the catheter. There is no embarrassment or obvious indicator of medical supplies being on the person of the patient with the present invention. FIGS. 6 and 8 show other embodiments of the front panel face. FIG. 6 shows an insert panel means 168 with a front panel face 170 with a different configuration of pockets 176 and straps 178. Straps 178 can be used to hold boxes of supplies, while a pouch 180 holds materials behind the box. Straps 178 may be analogous to straps 78 of FIG. 7. The different insert panel 170 may be useful for other medical procedures, such as ostomy care, or other non-medical uses, such as tools or office supplies. FIG. 8 shows an insert panel means 268 with a front panel face 270 with still another different configuration of straps 278. These storage straps 278 can have hook and loop connectors for holding a computer, so that the carrying case system 10 can be converted for use as a computer bag after the need for transporting medical supplies has passed. The storage straps 278 extend from one end of the insert panel means 268 to an opposite end of the insert panel means 268.

Various attachments to the embodiment of the carrying case system 10 of the present invention are shown in FIGS. 5 and 10. A mounting hook means 82 attaches the carrying case system 10 to a wall, wall hook, rail, door, bar or any suitable and strong structure. The mounting hook means 82 eliminates the need for counter space to access the medical supplies and perform the medical procedures. The mounting hook means 82 has three U-shaped curvatures, wherein one center curvature is between two smaller curvatures. The U of the center curvature faces a direction opposite the two smaller curvatures. The mounting hook means 82 can be removably contained in the body portion 14, such as the pocket means 48 or inner pocket 26. In some embodiments, the pocket means 48 has an inner retention pocket for holding the mounting hook means 82. The inner retention pocket holds the mounting hook means 82 within the pocket means 48 so that the mounting hook means 82 do not slide too deep within the pocket means 48. The inner retention pocket can comprise a pouch or a set of hook and loop fasteners suitable for holding the mounting hook means 82 in place. FIG. 10 shows the mounting hook means 82 engaging the transport strap means 16 or the side loops 46 of the handle means 18. Other combinations of the transport strap means 16, handle means 18, other parts of the body portion 14, and one or multiple mounting hook means 82 can be used to position the carrying case system 10 for use in different spaces.

There is also a lanyard clip 84 having a first toothed end and a second toothed end. Similar to the mounting hook means 82, the lanyard clip 84 can be removably contained in the body portion 14, such as the pocket means 48. Also, the lanyard clip 84 can be removably contained in the front panel 12, such as the front pocket 24. The lanyard clip 84 attaches to the patient to hold clothing away from the medical procedure being performed on the patient. The lanyard clip 84 may also be placed around the neck of the patient.

The method of using the carrying case system 10 includes placing the front panel 12 and the body portion 14 in an open position. FIG. 5 shows one open position for access to inner parts of the system 10. Next, the insert panel means 68 is installed into the interior volume 32 of the body portion 14. Any insert panel means 68, 168, 268 can be installed, according to the needs and preferences of the patient. The front panel face 70 of the insert panel means 68 is filled with supplies according to configuration of the front panel face 70. Alternative supplies can fit into other front panel faces 170, 270. Now, the carrying case system 10 can be closed by engaging the rim edge 36 to the front panel 12. The supplies are portable and discretely camouflaged for everyday use and public appearance.

In order to access supplies from the body portion 14, the patient should orient the body portion 14 with the top end 44 above the bottom end 40 and place the front panel 12 and the body portion 14 in an open position. The hinge portion 38 of the body portion 14 is actuated to lower the front panel 12 so that the adjustable hold strap means 60 form a table surface 64 with the back face 22 of the front panel 12. Before opening, a mounting hook means 82 can be removed from the body portion 14 to be used to attach the body portion 14 to at least one curvature of the mounting hook means 82. Another curvature, usually the center curvature, can be placed over a support structure, such as a stall wall or a rail. The mounting hook means 82 can be removed from storage from the pocket means 48, or even from the front pocket 24 of the front panel. The mounting hook means 82 can attach to the transport strap means 16 or the closed loop 46 of the handle means 18. Various combinations of the transport strap means 16, handle means 18, other parts of the body portion 10 and either one or multiple hook means 82 can be used to mount the carrying case system 10 in a particular location and on a particular structure.

The supplies can now be used for medical procedures performed in limited space away from the patient's home. For example, catheters can hang from suspension clips 62 on the adjustment strap means 60. Waste disposal bags can also be held by the suspension clips 62 on the adjustment strap means 60. A lanyard clip 84 contained in the body portion can attach to clothing of the patient for ease of performing the medical procedures. The lanyard clip 84 is easily and conveniently stored and transported along with the other medical supplies in the carry case system 10 of the present invention.

In order to switch supplies from the body portion 14, the patient should orient the body portion 14 with the top end 44 above the bottom end 40 and place the front panel 12 and the body portion 14 in an open position. The hinge portion 38 of the body portion 14 is actuated to lower the front panel 12 so that the adjustable hold strap means 60 form a table surface 64 with the back face 22 of the front panel 12. The insert panel means 68 is removed from the body portion 14, releasing the attachment means 66 of the body portion 14 from a complementary attachment means 74 of the insert panel means 68. A substitute insert panel means 168 or 268 with a substitute configuration on a front face 170, 270 of the substitute insert panel means 168, 268. The front panel face 170, 270 of the substitute insert panel means 168, 268 can be filled with supplies according to configuration of the substitute insert panel means 168, 268. Again, the carrying case system 10 can be closed to transport the new supplies in the same discrete and convenient manner.

The embodiments of the present invention provide a carrying case for transporting a variety of different medical supplies. Oddly shaped container and tools can be housed in the carrying case of the present invention without obvious visual indicators to casual observers of the carrying case. Entire bottles of fluids and ointments can be transported and maintained clean and generally sterile, while becoming portable away from the home. Additionally, the present invention organizes this variety of different medical supplies for diligent use and monitoring of supply levels. Removable and interchangeable insert panels increase the functionality even further. Different sets of supplies and organization can be applied according to the configuration of a particular insert. Each insert is easy to install and easy to remove according to changing needs of the patient for medical supplies. In addition to transporting medical supplies, there are non-medical uses of the present invention for the patient. Whether or not there are continuous or temporary medical conditions, a patient is able to benefit from the money spent on the carrying case of the present invention. For example, other insert configurations or even the same insert configurations can hold office or classroom supplies. An insert with storage straps can be used to convert the carrying case for medical supplies into a carrying case for a laptop computer.

Embodiments of the present invention further provide a carrying case with special utility for performing medical procedures. The carrying case is compatible with attachments, such as suspension hooks required for self-catheterization. These medical procedures can now be performed away from the patient's residence, providing freedom to travel and attend events outside of the home. Additionally, the carrying case transports a work space for medical procedures. The work space can be cleaned and generally sterilized for each use in a convenient and innovative carrying case. Even in limited space, the present invention can be mounted and opened to work space. Patients become free to attend business meeting, outdoor events, and concerts without the constraint of requiring medical supplies and space to perform medical procedures. The anxiety of being away from home and without the proper supplies and environment is alleviated by the carrying case of the present invention. To remove further stigma of the medical condition, the carrying case of the present invention can be transported and carried without visual indicators of the medical supplies contained inside the case. No obvious catheters, ostomy bags, wound care patches or other medical supplies, protrude from the carrying case, and casual observers will not be alarmed by a patient transporting supplies in public. The outer appearance of the present invention can increase utility as a carrying case for medical supplies, and later, as a carrying case for non-medical uses, such as a computer bag.

The foregoing disclosure and description of the invention is illustrative and explanatory thereof. Various changes in the details of the described system and method can be made without departing from the true spirit of the invention.

I claim:

1. A carrying case system comprising:

a front panel having a front face and a back face;

a body portion having a front side, a back side, and a perimeter of side walls forming an interior volume on said front side of said body portion, wherein the side walls have a rim edge releasably attached to said front panel, and wherein the side walls have a hinge portion pivotally attached to said front panel at a bottom end of said body portion;

a transport strap means having ends removably attached to an outside of said perimeter of side walls towards a top end of said body portion;

a handle means fixedly attached to said top end of said body portion and opposite said hinge portion on said bottom end of said body portion, said handle means having side loops flush against a top of said handle means;

an adjustable hold strap means having one end attached toward said top end of said body portion and another end attached to said front panel, wherein a closed position of said front panel and said body portion comprises attachment of said front panel to said rim edge, said hinge portion being actuated so that said front face and said back face of said front panel are aligned with said front side and said back side of said body portion, and wherein an open position of said front panel and said body portion comprises release of said front panel from said rim edge, said hinge portion being actuated so that said front face and said back face of said front panel are supported by said adjustable hold strap means, said adjustable hold strap means being extended in said open position;

an attachment means mounted on said front side of said body portion; and an insert panel means, removably attached to said attachment means within said interior volume of said body portion, said insert panel means having a front panel face and a back panel face, said back panel face engaging said attachment means on said body portion;

a plurality of mounting hooks, each mounting hook having three U-shaped curvatures, wherein one curvature is between two smaller curvatures and faces a direction opposite said two smaller curvatures, and wherein each side loop of said handle means engages at least one smaller curvature of a respective mounting hook, said front panel being held in a horizontal position relative to said body portion and each mounting hook in the open position; and a plurality of suspension hooks, each suspension hook being movable along said adjustment hold strap means, wherein said insert panel means further comprises:

a complementary attachment means spread across said back panel face along a perimeter and across a center of said back panel face so as to engage said attachment means of said body portion;

a pocket extending diagonally across said front panel face of said insert panel, said pocket having a length greater than a distance between side walls of said body portion, said complementary attachment means on said back panel face crossing behind said pocket so as to support both top and bottom portions of said pocket; and a medical supply extending from one end of said pocket to an opposite end of said pocket, wherein at least one medical supply has one end releasably engaged to a respective suspension hook, said at least one medical supply being held vertical relative to said front panel in said open position, and wherein said insert panel means is friction fit into said front side of said body portion and releasably engaging said side walls.

2. The carrying case system, according to claim 1, said front panel having a front pocket made integral with said front face, said front panel having an inner pocket housed within said front pocket, said inner pocket being comprised of transparent material.

3. The carrying case system, according to claim 1, said body portion has a back side comprised of a loop strap extended across said back side of said body portion.

4. The carrying case system, according to claim 1, forming a table surface in said open position, wherein said front panel hinges relative to said body portion according to a length of said adjustable hold strap means, said back face of said front panel being a smooth work surface, and wherein said back face is supported relative to said body portion by said adjustment hold strap means.

5. The carrying case system, according to claim 1, said attachment means comprising a fastener selected from a group consisting of a button, snap, zipper, clip, adhesive, and friction fit connector, said insert panel means having a complementary attachment means comprised of a fastener selected from a group consisting of a button, snap, zipper, clip, adhesive, and friction fit connector, said complementary attachment means for removable attachment to said body portion.

6. The carrying case system, according to claim 1, wherein said front panel face of said insert panel means further comprises a plurality of pockets positioned around said pocket extending diagonally.

7. The carrying case system, according to claim 1, wherein said front panel face of said insert panel means further comprises a plurality of supply straps positioned around said pocket extending diagonally.

8. The carrying case system, according to claim 1, wherein said front panel face of said insert panel means further comprises a plurality of storage straps positioned around said pocket extending diagonally.

9. The carrying case system, according to claim 1, further comprising:

a lanyard clip having a first toothed end and a second toothed end, said lanyard clip being removably contained in said body portion.

* * * * *